US008365832B2

(12) United States Patent
Martin et al.

(10) Patent No.: US 8,365,832 B2
(45) Date of Patent: Feb. 5, 2013

(54) POSITION RETENTION MECHANISM FOR MAINTAINING A COUNTER MECHANISM IN AN ACTIVATED POSITION

(75) Inventors: Lauren M. Martin, Bryan, TX (US); Seth Conaway, Houston, TX (US); Steven L. Anyan, Missouri City, TX (US); Joseph O. Glasofer, Houston, TX (US); Alexander R. Barnett, Houston, TX (US); Anthony Villarreal, Lake Jackson, TX (US); Brad Swenson, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 454 days.

(21) Appl. No.: 12/695,144

(22) Filed: Jan. 27, 2010

(65) Prior Publication Data

US 2011/0180270 A1 Jul. 28, 2011

(51) Int. Cl.
*E21B 23/04* (2006.01)

(52) U.S. Cl. ..... 166/374; 166/321; 166/331

(58) Field of Classification Search ..... 166/240, 166/319, 321, 331, 332.1, 373, 374
See application file for complete search history.

(56) References Cited

U.S. PATENT DOCUMENTS

| | | | | |
|---|---|---|---|---|
| 4,657,082 | A * | 4/1987 | Ringgenberg | 166/336 |
| 5,372,197 | A * | 12/1994 | Wacker | 166/311 |
| 5,529,126 | A * | 6/1996 | Edwards | 166/331 |
| 5,609,178 | A * | 3/1997 | Hennig et al. | 137/10 |
| 6,152,224 | A * | 11/2000 | French | 166/250.08 |
| 6,173,795 | B1 * | 1/2001 | McGarian et al. | 175/231 |
| 6,227,298 | B1 | 5/2001 | Patel | |
| 6,230,807 | B1 | 5/2001 | Patel | |
| 6,302,216 | B1 | 10/2001 | Patel | |
| 6,352,119 | B1 | 3/2002 | Patel | |
| 6,502,640 | B2 | 1/2003 | Rayssiguier et al. | |
| 6,550,541 | B2 * | 4/2003 | Patel | 166/386 |
| 6,662,877 | B2 | 12/2003 | Patel | |
| 6,691,785 | B2 | 2/2004 | Patel | |
| 7,124,824 | B2 * | 10/2006 | Turner et al. | 166/374 |
| 7,216,713 | B2 | 5/2007 | Read, Jr. | |
| 7,347,272 | B2 | 3/2008 | Patel et al. | |
| 7,866,402 | B2 * | 1/2011 | Williamson, Jr. | 166/374 |
| 2005/0199399 | A1 * | 9/2005 | Hayter et al. | 166/334.1 |
| 2005/0263286 | A1 | 12/2005 | Sheffield | |
| 2007/0056745 | A1 | 3/2007 | Contant | |
| 2009/0084553 | A1 | 4/2009 | Rytlewski et al. | |
| 2009/0242199 | A1 | 10/2009 | Basmajian et al. | |
| 2009/0308588 | A1 | 12/2009 | Howell et al. | |
| 2009/0308607 | A1 | 12/2009 | Anyan | |
| 2011/0278017 | A1 * | 11/2011 | Themig et al. | 166/373 |

FOREIGN PATENT DOCUMENTS

| | | | |
|---|---|---|---|
| GB | 2339226 | A | 1/2000 |
| GB | 2377464 | B | 3/2004 |
| WO | 2004088091 | A1 | 10/2004 |

* cited by examiner

*Primary Examiner* — Daniel P Stephenson
(74) *Attorney, Agent, or Firm* — Brandon S. Clark; Rodney Warfford

(57) ABSTRACT

To operate a device for use in a well, a counter mechanism is provided that is actuatable by pressure cycles to an active position that allows actuation of the device to a target state. A position retention mechanism is coupled to the counter mechanism to maintain the counter mechanism in the active position once the counter mechanism has been incremented by the pressure cycles to the active position.

19 Claims, 3 Drawing Sheets

POSITION RETENTION MECHANISM FOR MAINTAINING A COUNTER MECHANISM IN AN ACTIVATED POSITION

BACKGROUND

Various types of equipment may be deployed in a well for enabling production or injection of fluids through the well. Examples of such equipment include tubings, valves, and sealing elements for controlling fluid flow.

One type of valve deployed in a well is a formation isolation valve. When closed, the formation isolation valve isolates one region of the well from another region of the well, such that fluid flow is blocked between the two regions. Formation isolation valves can be actuated between an open position and a closed position using an operating mechanism. Typically, the operating mechanism is a hydraulically or pressure-actuated operating mechanism. In some implementations, the hydraulically or pressure-actuated operating mechanism may include a counter or indexing mechanism that is incrementally advanced in response to application of successive pressure cycles. A counter mechanism may have multiple positions, where at least one of the positions (e.g., an "active position") corresponds to a position in which the formation isolation valve is configured to be actuated to an open position. The remaining positions of the counter mechanism may correspond to positions configured to maintain the formation isolation valve in a closed position.

In some cases, the presence of debris or other faults may prevent the formation isolation valve from being successfully actuated to the open state, even though the counter mechanism has been incremented to its active position. When this occurs, any further pressure cycles will cause the counter mechanism to leave its active position. This situation would require the performance of another round of multiple pressure cycles in order to actuate the formation isolation valve to its open position, which is time-consuming and expensive.

SUMMARY

In general, according to an embodiment, an apparatus to operate a device for use in a well includes a counter mechanism actuatable by pressure cycles to an active position for actuating the device to a target state. In addition, the apparatus has a position retention mechanism coupled to the counter mechanism to maintain the counter mechanism in the active position once the counter mechanism has been incremented by the pressure cycles to the active position.

Other or alternative features will become apparent from the following description, from the drawings, and from the claims.

BRIEF DESCRIPTION OF THE DRAWINGS

Certain embodiments of the invention will hereafter be described with reference to the accompanying drawings, wherein like reference numerals denote like elements. It should be understood, however, that the accompanying drawings illustrate only the various implementations described herein and are not meant to limit the scope of various technologies described herein. The drawings are as follows.

DETAILED DESCRIPTION

Figure 1:
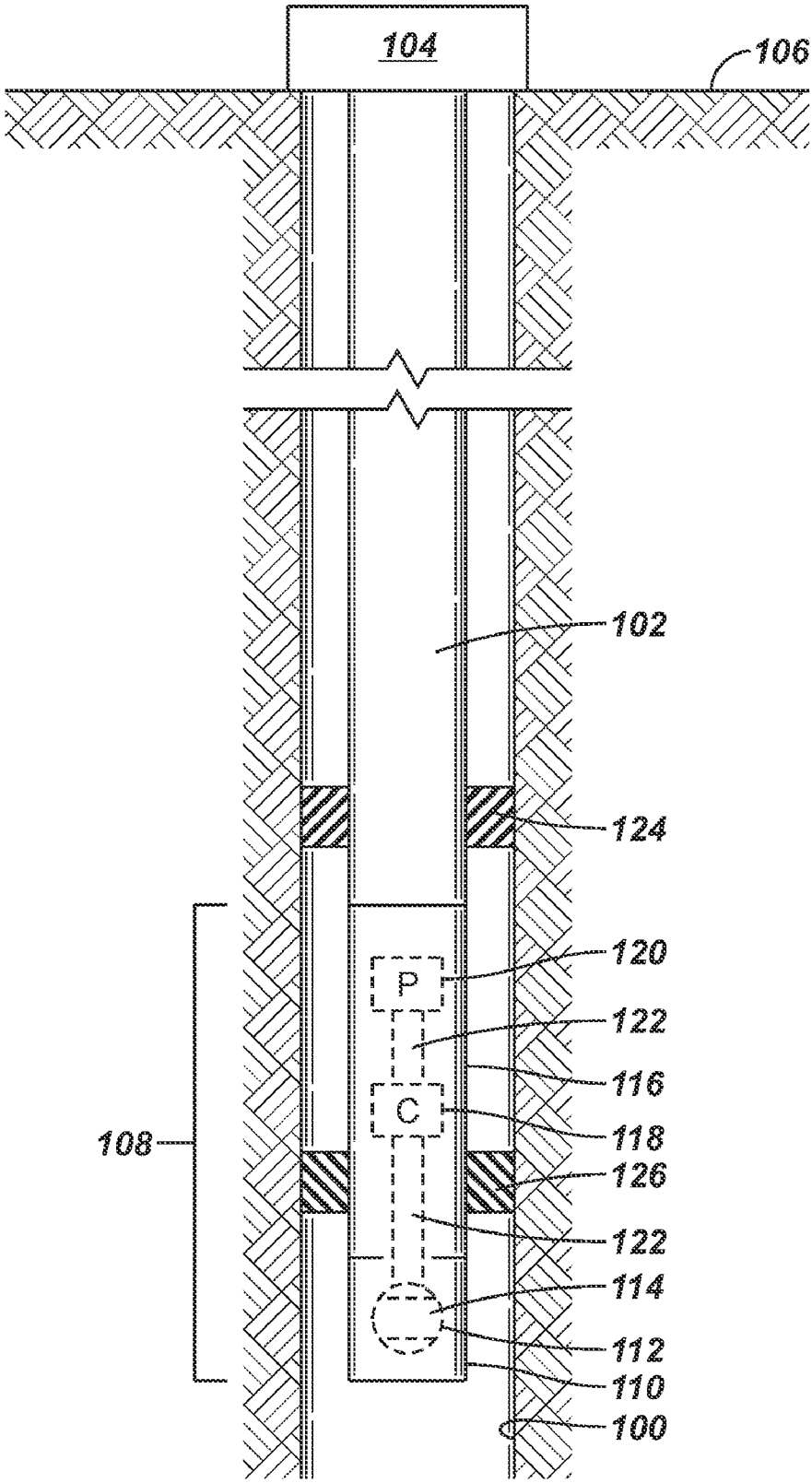
FIG. 1 is a schematic diagram of a tool string including a counter mechanism and position retention mechanism coupled to the counter mechanism, according to an embodiment.

In the following description, numerous details are set forth to provide an understanding of the present invention. However, it will be understood by those skilled in the art that embodiments of the present invention may be practiced without these details and that numerous variations or modifications from the described embodiments are possible.

As used here, the terms "above" and "below"; "up" and "down"; "upper" and "lower"; "upwardly" and "downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or diagonal relationship as appropriate. In the specification and appended claims: the terms "connect", "connection", "connected", "in connection with", "connecting", "couple", "coupled", "coupled with", and "coupling" are used to mean "in direct connection with" or "in connection with via another element".

In accordance with some embodiments, a position retention mechanism is provided and operably coupled to a counter mechanism in order to maintain the position of the counter mechanism once the counter mechanism has been incremented by pressure cycles to an active position of the counter mechanism. The "active position" of the counter mechanism corresponds to a position of the counter mechanism where an operating mandrel, which is operatively coupled to the counter mechanism, is allowed to actuate a downhole device to a target state.

In some embodiments, the downhole device that is to be actuated can be a valve, such as a formation isolation valve. The target state of the valve can be an opened state or a closed state, depending upon the application. In the ensuing discussion, reference is made to a formation isolation valve as an example of the downhole device. The target state of the formation isolation valve in the illustrative embodiments discussed is the open state. Note that in other embodiments, the downhole device can be another type of device, such as a sealing element, another type of valve, and so forth, and the target state can be another state, such as a closed state, incremental position, and others as appropriate.

An "operating mandrel" that is operatively coupled to the counter mechanism refers to a moveable member that is moveable between different positions. For example, a first position of the operating mandrel may cause the formation isolation valve to be closed, while a second position of the operating mandrel may cause the formation isolation valve to be opened. Although reference is made to "operating mandrel" in the singular sense, note that the operating mandrel can actually include multiple elements that are directly or indirectly coupled together.

Pressure cycles may be applied to the counter mechanism in order to actuate the counter mechanism between different positions. A "pressure cycle" refers to a sequence of an elevated pressure and a reduced pressure. The counter mechanism may be actuated on the application of elevated or reduced pressure, or actuated through the elevated and reduced pressure sequence. In the ensuing discussion, it is assumed that the illustrative counter mechanism has just one active position and multiple non-active positions. In other exemplary embodiments, it is possible for the counter mechanism to have multiple active positions. In the non-active positions of the counter mechanism, the operating mandrel is not allowed to actuate the formation isolation valve to an open position (i.e., when the counter mechanism is in a non-active position, the operating mandrel is either kept in a single position or allowed to move between positions that maintain the formation isolation valve in the closed position).

The position retention mechanism maintains the counter mechanism in an active position by preventing or inhibiting the counter mechanism from moving from an active position to a non-active position. Maintaining the counter mechanism in the active position can be useful in various applications. For example, when the counter mechanism initially reaches its active position, the presence of debris or another fault condition may prevent the formation isolation valve from being successfully actuated to its target state (e.g., the open position).

When such a condition is detected, a well operator would normally perform some intervention operation to remove the condition, such as by flowing fluid to the debris containing region of the well in order to remove the debris, or by performing another intervention operation to fix a fault condition in the tool. Once the condition that prevents opening of the formation isolation valve is removed, the formation isolation valve may then be able to open. However, in a situation in which no position retention mechanism is provided, another cycle may be inadvertently applied to the counter mechanism during the actions performed to clear the debris or fault, or the counter mechanism may be otherwise incremented. The counter mechanism would then go from the active position to the adjacent non-active position. As a result, the well operator would have to apply another round of multiple pressure cycles in order to increment the counter mechanism back to the active position, which can be quite time consuming.

On the other hand, if a position retention mechanism according to some embodiments is used, the counter mechanism is maintained in its active position once the counter mechanism reaches such active position. Therefore, another pressure cycle would not increment the counter mechanism out of its active position. As a result, the operating mandrel can actuate the formation isolation valve to an opened position when the debris or fault is cleared.

FIG. 1 illustrates exemplary completion equipment that may include tubing 102 installed in a well 100. The tubing 102 can be production tubing for producing fluids from a surrounding reservoir to the earth surface 106. Alternatively, the tubing 102 can be injection tubing for injecting fluids into the surrounding reservoir. Of course, some tubing 102 may be used for both injection and production. The tubing 102 may extend from wellhead equipment 104 located at the earth surface 106.

A valve assembly 108 is attached below a sealing element 124 (e.g., such as a packer) to the lower end of the production tubing 102. However, locations of valve assemblies may not be limited to this illustrative example. Other valve assembly locations may be above or concurrent with a packer 124 or may include multiple valve assemblies in multiple producing zones, such as in multiple intervention completions. The valve assembly 108 may comprise a formation isolation valve 110, which can be implemented with a ball valve for example. A ball valve may include a ball that has an inner bore 114 through which fluids can pass. The ball is rotated between different positions. In a closed position the ball 112 is oriented to prevent fluid from flowing through the inner bore 114, and in an open position the ball is aligned with a fluid flow path to allow fluid to pass through the inner bore 114. Although the term "ball" is used to describe the formation isolation valve, this term should not be limited to its literal spherical geometric definition. Other types of ball valves may include half ball sections, rotating cylindrical sections or other configurations.

The valve assembly 108 may further comprise an operating mechanism 116 that includes a counter mechanism 118 and a position retention mechanism 120. The counter mechanism 118 may be incremented among its incremental positions by applications of hydraulic pressure cycles via the tubing 102 (e.g., such as from a hydraulic pressure source, not shown, provided at the earth surface 106). In an alternative implementation, the application of hydraulic pressure cycles can be applied through a hydraulic control line (not shown) that may extend from the wellhead equipment 104 at the earth surface 106 into the wellbore and extend to the operating mechanism 116. In some exemplary embodiments, the operating mechanism 116 also includes an operating mandrel 122 that is shiftable between different positions for actuating the ball valve 110 between the open position and closed position. Also shown in FIG. 1 are sealing elements 124 and 126 (e.g. such as packers for example) for sealing various annular regions in the well 100.

Although the schematic diagram of FIG. 1 shows the counter mechanism 118, position retention mechanism 120, and operating mandrel 122 as occupying a centralized location within the area defined by operating mechanism 116, it is noted that in practice, the various components of the operating mechanism 116 may be implemented in an annular region around an inner bore, The inner bore extends through the area bounded by the schematic representation of the operating mechanism 116 and forms part of a fluid path. In operation, when the formation isolation valve 112 is in its open position, fluids (e.g., production fluids or injection fluids) can flow through the inner bore 114 of the formation isolation valve 112, the inner bore through the area of the operating mechanism 116, and the inner bore of the tubing 102, in the example shown. Note that FIG. 1 illustrates one exemplary arrangement of the tool string and operating mechanism 116. In other implementations, other arrangements and configurations can be employed.

Figure 2:
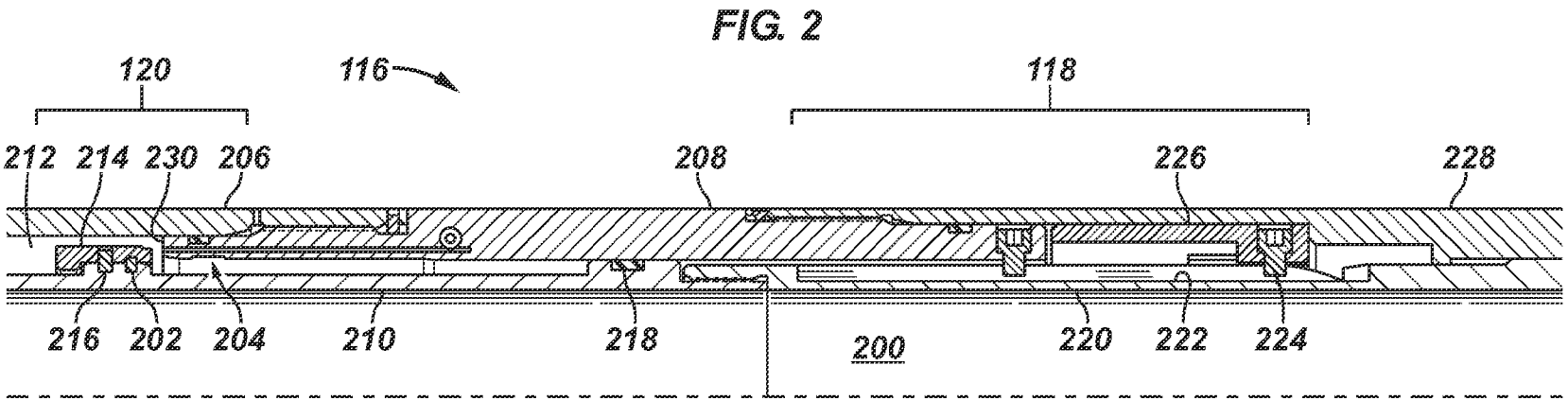
FIG. 2 is a sectional view of a portion of the tool string that includes the counter mechanism and position retention mechanism, according to an embodiment.

FIG. 2 illustrates a partial cross-sectional portion of the operating mechanism 116 of FIG. 1, according to an embodiment. As described earlier, the operating mechanism 116 may include the exemplary counter mechanism 118 and position retention mechanism 120 shown in the drawing. Also shown is an inner bore 200 along the length of the operating mechanism 116 through which fluid can flow. Only one half of the cross-sectional portion of the operating mechanism 116 is shown, and it may be assumed for the purposes of simplifying the detailed description that the operating mechanism 116 is substantially symmetrical about an axis defining the inner bore 200.

The position retention mechanism 120 may include a locking member 202 and a locking profile 204, according to the illustrative embodiment. The locking member 202 may be configured to be lockingly coupled to or engageable with the locking profile 204, which in some embodiments may be a groove formed in an intermediate housing section 208, for example. The intermediate housing section 208 may be attached (e.g., such as by threaded connection) to a gas chamber housing section 206. The housing sections 206, 208, in cooperation with a gas chamber mandrel 210, define a gas chamber 212 between the housing sections 206, 208 and the mandrel 210. The gas chamber 212 may be a sealed gas chamber that contains a gas, such as nitrogen or other type of gas. Alternatively, the sealed chamber 212 can contain a liquid or be functionally replaced with a resilient member such as a spring, for example. In still other cases, there may be a pressure source to actively drive the gas chamber mandrel 210 in a first direction and another pressure source to actively drive the gas chamber mandrel 210 in a direction opposite to the first direction (of course, other mandrels may be driven as well as or in place of the gas chamber mandrel 210). The gas in the gas chamber 212 may be maintained at an elevated pressure in order to be able to apply a downward force against a shear sleeve 214 that is initially attached to the gas chamber mandrel 210 by a shear element 216. The shear element 216 can be a shear pin, shear screw, or other form of temporary restraint, for example.

A sealing element 218 may be provided on an outer wall of the gas chamber mandrel 210. The sealing element 218 (e.g., one or more O-ring seals, or other types of seals) may be engaged with the inner wall of the intermediate housing section 208 in order to establish and maintain a sealed gas chamber 212. The gas chamber mandrel 210 may be threadably connected at its lower end (i.e., the rightmost end which is the end shown closest to counter mechanism 118 as viewed in FIG. 2) to a cycle mandrel 220, which is part of the counter mechanism 118. The outer surface 222 of the cycle mandrel 220 may be configured with slots or pathways, which will be referred to as J-slots.

An engagement member, such as pin 224, may be configured to be accommodated within and to travel relative to the slots. The pin 224 may be attached to a rotatable spline sleeve 226, which is rotably arranged inside of a counter housing section 228. The counter housing section 228 may be attached at its upper portion (i.e., the leftmost end which is the end shown closest to position retention mechanism 120 as viewed in FIG. 2) to the intermediate housing section 208. As the engagement pin 224 travels relative to the slots of the counter mechanism 118 in response to pressure cycles, the cycle mandrel 220 does not rotate but does translate back and forth longitudinally, while the rotatable spline sleeve 226 incrementally rotates relative to the counter housing section 228.

The slots formed in the outer surface 222 of the cycle mandrel 220 may include a number of slots having a first length, and at least one elongated slot having a second length that is longer than the first length, although the particular combination and configuration of the slots may be determined as appropriate for a specific application. In this illustrative example, when the pin 224 is inside one of the shorter slots, the counter section 118 is considered to be in a non-active position. Once the pin 224 has traveled to the elongated slot in response to the application of pressure cycles, then the counter mechanism 118 is considered to be in its active position. When the pin 224 is in the elongated slot or actuatable length slot of the counter mechanism 118, the mandrels 210 and 220 are able to shift downwardly (i.e., to the right) through a particular distance determined to allow for actuation of the ball valve 110 (see FIG. 1) to the open position. The mandrels 210 and 212 may be considered to be part of the operating mandrel 122 shown in FIG. 1.

In response to pressure cycles, the cycle mandrel 220 may be shifted back and forth in the longitudinal direction, which causes the pin 224 to move between adjacent slots. This incremental movement of the pin 224 between adjacent slots increments the counter mechanism 118. Activation of an elevated pressure of a particular pressure cycle causes the cycle mandrel 220 to shift in the upward direction (i.e., to the left). When the elevated pressure is removed (resulting in the application of a reduced pressure), then the stored pressure inside the gas chamber 212 (e.g., gas spring) would cause the cycle mandrel 220 to shift backward in the lower direction (i.e., to the right).

Figure 3:
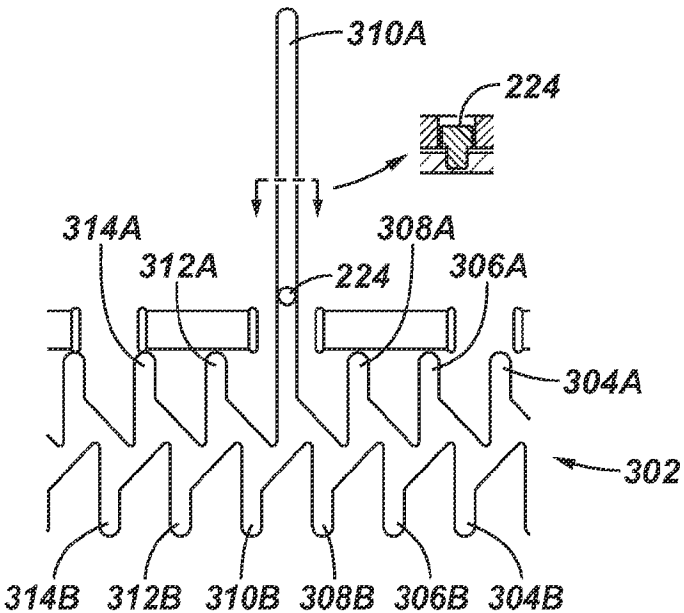
FIG. 3 is a side view of a counter mechanism used in the tool string according to an embodiment.

FIG. 3 shows an illustrative example of a slot arrangement 302 of the counter mechanism 118. Slot arrangement 302 may include slots 304, 306, 308, 310, 312, and 314, formed in the surface 222 of the cycle mandrel 220. Each slot may include two slot segments, A and B. For example, slot 304 includes slot segments 304A, 304B; slot 306 includes slot segments 306A, 306B; slot 308 includes slot segments 308A, 308B; slot 310 includes slot segments 310A, 310B; slot 312 includes slot segments 312A, 312B; and slot 314 includes slot segments 314A, 314B. The pin 224 travels via the slots 304-314. A pressure cycle causes an up and down relative motion of the pin 224 compared to the slots. The motion causes the pin 224 (and rotatable spline sleeve 226) to rotate about an axis defining the central bore 200 (see FIG. 2) and move between adjacent slots. Thus, for example, assuming that pin 224 is initially in slot segment 304A, a pressure cycle would cause an up and down relative motion (as the cycle mandrel 220 (FIG. 2) longitudinally moves along with the slots) which would cause the pin 224 to relatively travel from slot segment 304A to slot segment 304B, and then to slot segment 306A. This pressure cycle effectively causes the pin 224 to relatively travel from slot 304 to slot 306. In addition, the rotatable spline sleeve 226 would rotate through an arc defined by the distance between 304A and 306A. The up and down pressure cycle represents an incremental movement of the counter section 118.

Slot 310 is an elongated slot or actuatable length slot that is longer than the other slots 304, 306, 308, 312 and 314. When the pin 224 is in the elongated slot segment 310A, the operating mandrel 122 (FIG. 1) (e.g., including mandrels 210 and 220 (FIG. 2)) is allowed to move downwardly by a sufficient distance necessary to actuate the ball valve 110 (FIG. 1) to an opened position. When the pin 224 is in one of the shorter slots 304, 306, 308, 312, and 314, the operating mandrel 122 is restricted from moving downwardly by a distance sufficient to actuate the ball valve 110. Accordingly, when the pin 224 is in one of the shorter slots, the ball valve 110 remains in its closed position.

Figure 4:
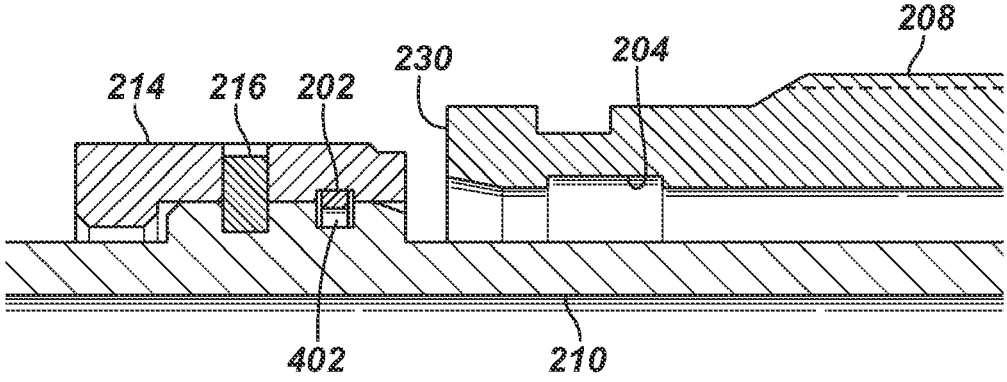
FIGS. 4 and 5 are schematic diagrams of the position retention mechanism in different positions, according to an embodiment.
Figure 5:
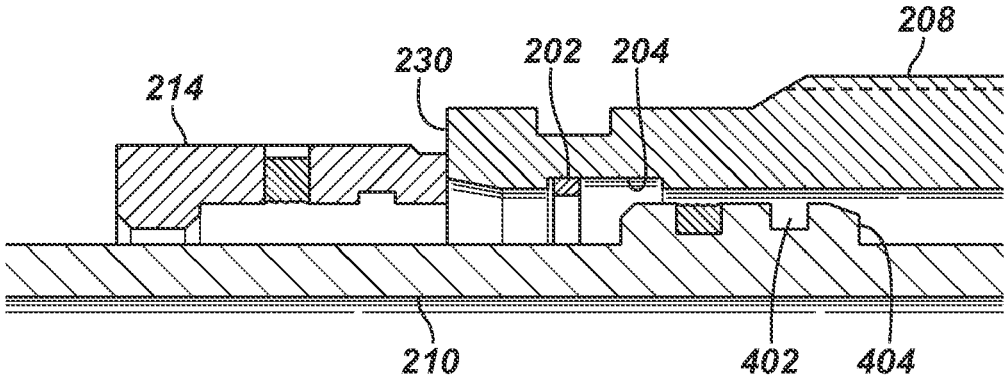

FIG. 4 is an enlarged cross-sectional view of a portion of an end of the operating mechanism 116 (FIG. 2) that shows the locking member 202 and locking groove 204 in greater detail. In some embodiments, the locking member 202 can be a compressed C-ring that is retained inside of a chamber 402 defined between the shear sleeve 214 and the gas chamber mandrel 210. When the gas chamber mandrel 210 has moved downwardly by a sufficient distance such that the C-ring 202 is positioned adjacent the locking groove 204, the C-ring 202 may expand (e.g., such as by a spring-loaded action) to couple with the inside of the locking groove 204, as shown in FIG. 5. Therefore, the C-ring 202 may be lockingly engaged with the locking groove 204.

In operation, pressure cycles applied by elevating and removing fluid pressure within the tubing 102 (FIG. 1) causes the gas chamber mandrel 210 and cycle mandrel 220 to translate in two directions. As a result, the pin 224 relatively travels from its current slot to an adjacent slot in the slot arrangement 302, such as those depicted in FIG. 3. If the adjacent slot segment is the elongated or actuatable length slot segment 310A, then the elevated pressure of the gas inside of the gas chamber 212 would cause the shear sleeve 214 to abut against an end (i.e., the upper) surface 230 of the lower gas chamber housing section 208. The gas chamber 212 should be configured so as to impart a sufficient force onto the shear sleeve 214 from the gas chamber mandrel 210 such that the shear pin 216 breaks. Once the shear pin 216 breaks, the gas chamber mandrel 210 is able to move further downwardly such that the C-ring 202 (FIGS. 4 and 5) expands and engages the locking groove 204.

Under normal operating conditions (i.e., no debris or other fault conditions preventing or inhibiting the opening of the ball valve 110) the location of the pin 224 in the actuatable length or elongated slot segment 310A enables the gas chamber mandrel 210 and cycle mandrel 220 (FIG. 2) to move downwardly by a sufficient distance required to open the ball valve 110 (FIG. 1). However, if debris or another fault condition is present, then the mandrels 210 and 220 may be restricted in their travel and unable to open the ball valve 110, even though the counter mechanism 118 is in an active position.

In accordance with some exemplary embodiments, the position retention mechanism 120 that includes the locking member 202 and locking groove 204 will prevent the pin 224 from exiting the elongated slot section 310A of the counter mechanism 118, maintaining the counter mechanism 118 in its active position. If another pressure cycle is inadvertently or directly applied in an effort to remove the debris or correct the fault condition, a protruding member 404 (FIG. 5) on the outer wall of the gas chamber mandrel 210 will engage the locking member 202 and prevent the gas chamber mandrel 210 from being able to move upwardly by a distance sufficient to allow the pin 224 to exit from the elongated slot segment 310A. In this manner, when the debris or other fault condition is removed (by performing an intervention operation, for example), the gas chamber mandrel 210 and the cycle mandrel 220 may be free to move a sufficient distance (defined by the elongated slot section 310A) to actuate the ball valve 110 to the open position.

Figure 6:
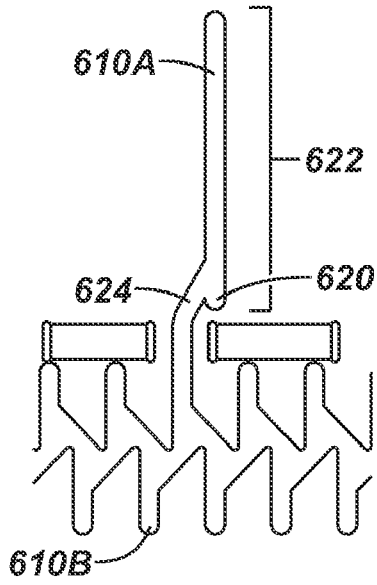
FIG. 6 is a side view of a counter mechanism that incorporates a position retention mechanism according to an alternative embodiment.

FIG. 6 illustrates an alternative embodiment of a position retention mechanism. Rather than using the position retention mechanism 120 (FIG. 1) that includes the locking member 202 and locking groove 204 (shown in FIGS. 2, 4, and 5), an alternative embodiment as shown in FIG. 6 provides a position retention mechanism by altering the configuration of the counter mechanism 118 (FIG. 1), specifically the configuration of the slots 302 shown in FIG. 3. In this embodiment, an altered actuatable length or elongated slot section 610A is provided. The altered elongated slot segment 610A has a notch 620 that is configured to receive the pin 224 when the pin 224 travels downwardly (as seen in FIG. 6). The notch 620 prevents the pin 224 from exiting the lower portion of the elongated slot segment 610A.

The elongated slot segment 610A has an angled portion 624 that allows the pin 224 to enter the actuation slot 622. However, once the pin 224 enters the actuation slot 622, the pin 224 will not be allowed to exit, thereby retaining the counter mechanism 118 in its active position.

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. An apparatus to operate a device for use in a well, comprising:

a counter mechanism actuatable by pressure cycles to an active position that allows actuation of the device to a target state; and a position retention mechanism coupled with the counter mechanism to maintain the counter mechanism in the active position, wherein the position retention mechanism comprises a locking member and a locking profile, wherein the locking member is configured to engage the locking profile once the locking member is moved adjacent the locking profile in response to the counter mechanism reaching the active position.

2. The apparatus of claim 1, wherein the counter mechanism comprises two or more slots, at least one of the slots being an actuatable length longer than the other slots, and wherein the counter mechanism further comprises:

an engagement member to move along the slots with successive actuations of the counter mechanism in response to the pressure cycles.

3. The apparatus of claim 2, wherein the active position of the counter mechanism corresponds to the engagement member being in the actuatable length slot.

4. The apparatus of claim 3, further comprising an operating mandrel coupled to the counter mechanism, wherein the operating mandrel is allowed to move through a particular distance to actuate the device to the target state in correspondence to movement of the engagement member in the actuatable length slot.

5. The apparatus of claim 4, wherein the counter mechanism is configured to prevent the operating mandrel from moving by the particular distance if the engagement member is in one of the slots other than the longer slot.

6. The apparatus of claim 1, further comprising:

a first housing section in which the locking profile is defined; and a moveable first mandrel on which the locking member is arranged, wherein movement of the first mandrel is defined by the counter mechanism.

7. The apparatus of claim 6, wherein the locking member is moved adjacent the locking profile once the first mandrel has moved by a distance allowed by the active position of the counter mechanism.

8. The apparatus of claim 6, wherein the locking member is an expandable C-ring.

9. The apparatus of claim 6, wherein the mandrel further has a protruding member that interacts with the locking member to prevent the mandrel from moving by a sufficient distance to allow the counter mechanism to exit the active position.

10. The apparatus of claim 6, wherein the counter mechanism has a cycle mandrel having a surface on which slots are formed, and where the cycle mandrel is attached to the first mandrel.

11. The apparatus of claim 1, wherein the position retention mechanism is provided by an element of the counter mechanism.

12. The apparatus of claim 11, wherein the counter mechanism has slots defined in a wall of the cycle mandrel, wherein one of the slots is an actuatable length longer than the other slots, wherein the active position of the counter mechanism is defined by the actuatable length slot, and wherein the element of the counter providing the position retention mechanism includes a notch that is part of the actuatable length slot.

13. The apparatus of claim 12, wherein the counter mechanism further comprises an engagement member to move along the slots, wherein the notch is engageable with the engagement member to prevent the engagement member from moving out of the actuatable length slot.

14. The apparatus of claim 13, wherein the actuatable length slot further has an angled section to allow the engagement member to enter a portion of the actuatable length slot that includes the notch, wherein the notch is positioned to prevent the engagement member from exiting the portion.

15. A method for use with a well, comprising:

positioning a device in the well;

cycling pressure to activate an operating mechanism; and activating the device to a target state after activating the operating mechanism a predetermined number of times;

wherein the operating mechanism includes a counter mechanism actuatable by the pressure cycles to an active position that allows the actuation of the device to the target state, and a position retention mechanism coupled to the counter mechanism to maintain the counter mechanism in the active position once the counter mechanism has been incremented by the pressure cycles to the active position, wherein the position retention mechanism comprises a locking member and a locking profile, wherein the locking member is configured to engage the locking profile once the locking member is moved adjacent the locking profile in response to the counter mechanism reaching the active position.

16. The method of claim 15, wherein the counter mechanism has two or more slots, wherein at least one of the slots is an active slot that is longer than the other slots, and wherein the active position corresponds to an engagement member being in the active slot, wherein activating the operating mechanism comprises incrementing the counter mechanism such that the engagement member enters the active slot, wherein entry of the engagement member into the active slot allows for activation of the position retention mechanism such that the counter mechanism is maintained in the active position.

17. The method of claim 16, further comprising:

in response to another pressure cycle, the position retention mechanism preventing the engagement member from exiting the active slot.

18. The method of claim 15, wherein positioning the device in the well comprises positioning a formation isolation valve in the well.

19. A system comprising:

a formation isolation valve for positioning in a well; and an operating mechanism for actuating the formation isolation valve to a target state, wherein the operating mechanism comprises:

a counter mechanism actuatable by pressure cycles to an active position that allows actuation of the formation isolation valve to the target state; and a position retention mechanism coupled to the counter mechanism to maintain the counter mechanism in the active position once the counter mechanism has been incremented by the pressure cycles to the active position, wherein the position retention mechanism comprises a locking member and a locking profile, wherein the locking member is configured to engage the locking profile once the locking member is moved adjacent the locking profile in response to the counter mechanism reaching the active position.

* * * * *